US007728496B2

(12) United States Patent
Choi et al.

(10) Patent No.: US 7,728,496 B2
(45) Date of Patent: Jun. 1, 2010

(54) ELECTRON EMISSION DEVICE HAVING CURVED SURFACE ELECTRON EMISSION REGION

(75) Inventors: Yong-Soo Choi, Suwon-si (KR); Sang-Jo Lee, Suwon-si (KR); Byong-Gon Lee, Suwon-si (KR); Chun-Gyoo Lee, Suwon-si (KR)

(73) Assignee: Samsung SDI Co., Ltd., Yeongtong-gu, Suwon-si, Gyeonggi-do (KR)

( * ) Notice: Subject to any disclaimer, the term of this patent is extended or adjusted under 35 U.S.C. 154(b) by 1260 days.

(21) Appl. No.: 11/063,966

(22) Filed: Feb. 24, 2005

(65) Prior Publication Data

US 2005/0189869 A1 Sep. 1, 2005

(30) Foreign Application Priority Data

Feb. 26, 2004 (KR) ..... 10-2004-0012954

(51) Int. Cl.
*H01J 1/62* (2006.01)
*H01J 63/04* (2006.01)

(52) U.S. Cl. ..... 313/310; 313/495

(58) Field of Classification Search ..... 313/495–497, 313/310, 311

See application file for complete search history.

(56) References Cited

U.S. PATENT DOCUMENTS

| | | | | |
|---|---|---|---|---|
| 3,789,471 | A | 2/1974 | Spindt et al. | |
| 5,604,394 | A | 2/1997 | Saito et al. | |
| 6,062,931 | A | 5/2000 | Chuang et al. | |
| 6,097,138 | A | 8/2000 | Nakamoto | |
| 6,297,592 | B1 | 10/2001 | Goren et al. | |
| 2003/0067259 | A1 * | 4/2003 | Nishimura | 313/310 |
| 2003/0128647 | A1 * | 7/2003 | Birecki et al. | 369/101 |
| 2004/0012327 | A1 * | 1/2004 | Shiratori et al. | 313/497 |

FOREIGN PATENT DOCUMENTS

| | | |
|---|---|---|
| CN | 1178998 | 4/1998 |
| CN | 1413353 | 4/2003 |
| JP | 2003-229044 | 8/2003 |

* cited by examiner

*Primary Examiner*—Bumsuk Won
(74) *Attorney, Agent, or Firm*—Robert E. Bushnell, Esq.

(57) ABSTRACT

An electron emission device includes first and second substrates opposing one another with a gap therebetween. Cathode electrodes are formed on the first substrate. An insulation layer is formed covering the cathode electrodes and having apertures. Gate electrodes are formed on the insulation layer and have apertures at locations corresponding to the locations of the apertures of the insulation layer so as to expose the cathode electrodes. Electron emission regions are formed in the apertures on the cathode electrodes. An anode electrode is formed on the second substrate. An outer surface of the electron emission regions is formed with a shape similar to a shape of equipotential lines formed when there is no electron emission region in the apertures, and predetermined drive voltages are applied to the electrodes.

5 Claims, 10 Drawing Sheets

ELECTRON EMISSION DEVICE HAVING CURVED SURFACE ELECTRON EMISSION REGION

CLAIM OF PRIORITY

This application makes reference to, incorporates herein, and claims all benefits accruing under 35 U.S.C. §119 from an application for ELECTRON EMISSION DEVICE earlier filed in the Korean Intellectual Property Office on 26 Feb. 2004 and there duly assigned Serial No. 2004-12954.

BACKGROUND OF THE INVENTION

1. Technical Field

The present invention relates to an electron emission device and, more particularly, to a structure of an electron emission region of the electron emission device.

2. Related Art

The different types of electron emission devices that use cold cathodes as electron emission regions include the field emitter array (FEA) type, the surface conduction electron emitter (SCE) type, and the metal/insulation layer/metal (MIM) type. In the case of the FEA type, materials that emit electrons with the application of an electric field are used as the electron emission region. The emitted electrons strike a phosphor layer to generate light. The overall quality of the FEA type is heavily dependent on the characteristics of the electron emission regions.

In the FEA type initially developed, molybdenum (Mo) was used as the material for the electron emission regions, and a conical configuration ending in a sharp point and having a size in the range of micrometers was employed. An example of such a conventional technology is disclosed in U.S. Pat. No. 3,789,471, which discloses a display device including field emission cathodes.

However, a serious drawback of the conventional electron emission region configuration is that it is necessary to use semiconductor processes to produce conical electron emission regions. This makes manufacturing difficult and reduces productivity. In addition, it is difficult to obtain uniform quality throughout the device as the substrate size is enlarged, making the conventional electron emission region structure unsuitable for application to devices with large sizes.

Therefore, those involved with FEA type manufacture and research are developing ways to form electron emission regions using a thick-layer process, such as screen printing, and are also using a carbon-based material capable of realizing favorable electron emission, even at low voltage driving conditions of approximately 10~50V. Examples of such carbon-based materials include graphite, diamond, diamond-like carbon, and carbon nanotubes. Also, nanometer-sized materials which may be used as electron emission regions include nano-tube, nano-wire and nano-fiber. Among these, nano-tubes, and especially carbon nano-tubes, appear to be very promising for use as electron emission regions because of their extremely minute tips (i.e., a radius of curvature of approximately 100 Å), and because carbon nanotubes are able to emit electrons in low electric field conditions of about 1~10V/μm.

Examples of conventional cold cathode FEAs utilizing carbon nano-tubes are disclosed in U.S. Pat. Nos. 6,062,931 and 6,097,138.

In the case wherein an FEA type employs what is referred to as a triode structure, including cathode electrodes an anode electrode, and gate electrodes, a top-gate structure may be used. In the top-gate structure, the cathode electrodes are first formed on a substrate, the electron emission regions are formed on the cathode electrodes, and the gate electrodes are then mounted on the electron emission regions.

SUMMARY OF THE INVENTION

In one exemplary embodiment of the present invention, there is provided an electron emission device that enables an electric field to be uniformly formed over entire surfaces of electron emission regions so that electrons are uniformly emitted and electron beam diffusion is minimized, and so that the electron emission regions are not excessively heated, thereby increasing the life of the electron emission regions.

In the exemplary embodiment of the present invention, an electron emission device includes: a first substrate and a second substrate provided in opposition to one another with a predetermined gap therebetween; a plurality of cathode electrodes formed on a surface of the first substrate opposing the second substrate; an insulation layer formed so as to cover the cathode electrodes, and having a plurality of apertures that pass therethrough formed at predetermined locations; a plurality of gate electrodes formed on the insulation layer, and having a plurality of apertures that pass therethrough, the apertures of the gate electrodes being formed at areas corresponding to the apertures of the insulation layer, and the apertures of the gate electrodes and of the insulation layer exposing the cathode electrodes; a plurality of electron emission regions formed in the apertures on the exposed areas of the cathode electrodes; and an anode electrode formed on a surface of the second substrate opposing the first substrate. A surface of the electron emission regions, opposite a surface adjacent to the cathode electrodes, is curved with a predetermined radius of curvature.

Long axes of the cathode electrodes and long axes of the gate electrodes are substantially perpendicular.

In an embodiment, the surface of the electron emission regions adjacent to the cathode electrodes is concavely formed toward the first substrate. In this case, areas of the electron emission regions corresponding substantially to centers of the apertures have the smallest thickness.

In another embodiment, the surface of the electron emission regions adjacent to the cathode electrodes is convexly formed away from the first substrate. In this case, the electron emission regions are positioned within the apertures contacting the insulation layer, and areas of the electron emission regions corresponding substantially to centers of the apertures have the greatest thickness.

In yet another embodiment, a surface of the electron emission regions opposite a surface adjacent to the cathode electrodes is formed in a shape similar to an overall shape of equipotential lines formed when there is no electron emission region in the apertures, and predetermined drive voltages are applied to the cathode electrodes, the gate electrodes, and the anode electrode.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Exemplary embodiments of the present invention will now be described in detail with reference to the accompanying drawings.

Figure 1:
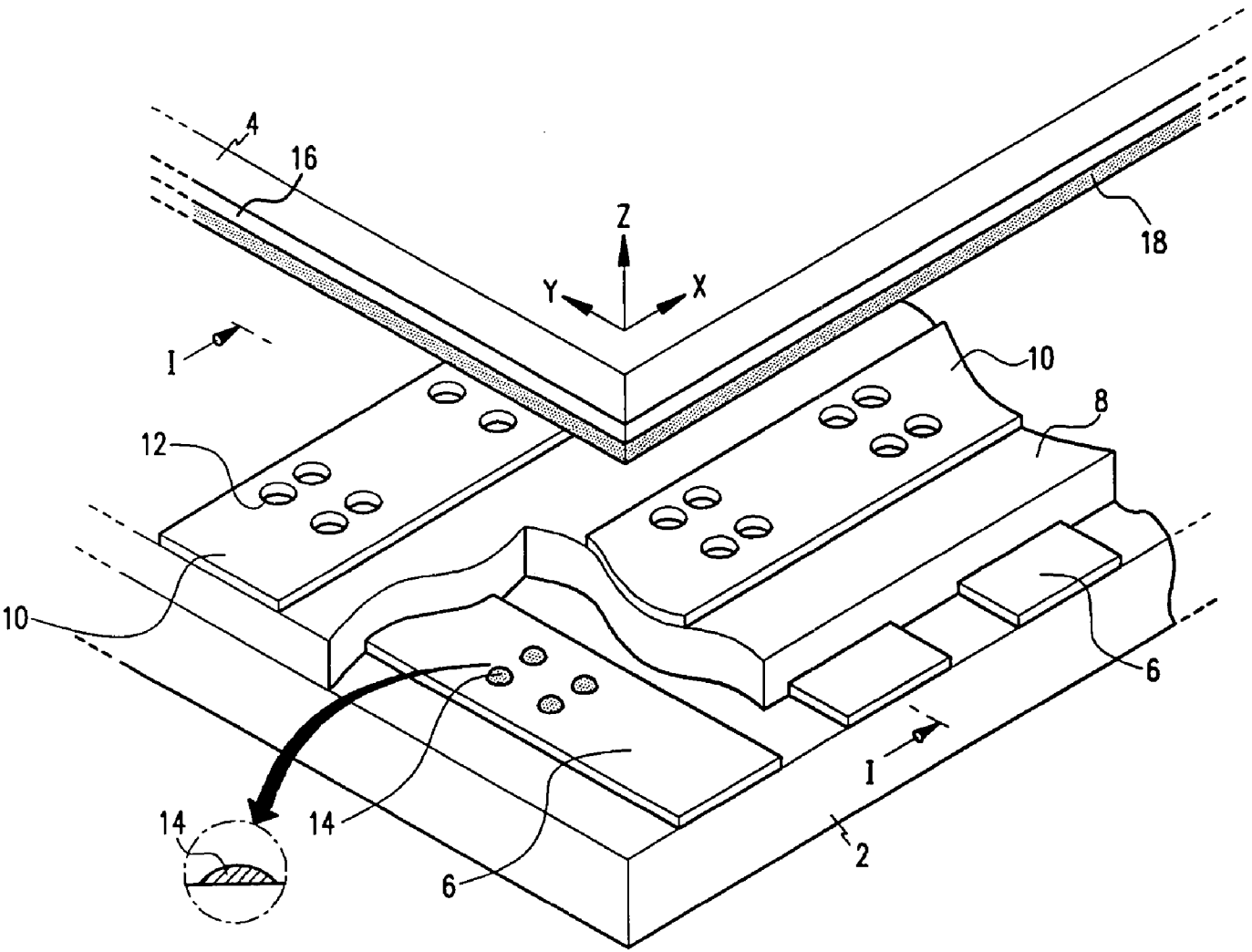
FIG. 1 is a partial exploded perspective view of an electron emission device according to a first exemplary embodiment of the present invention.
Figure 2:
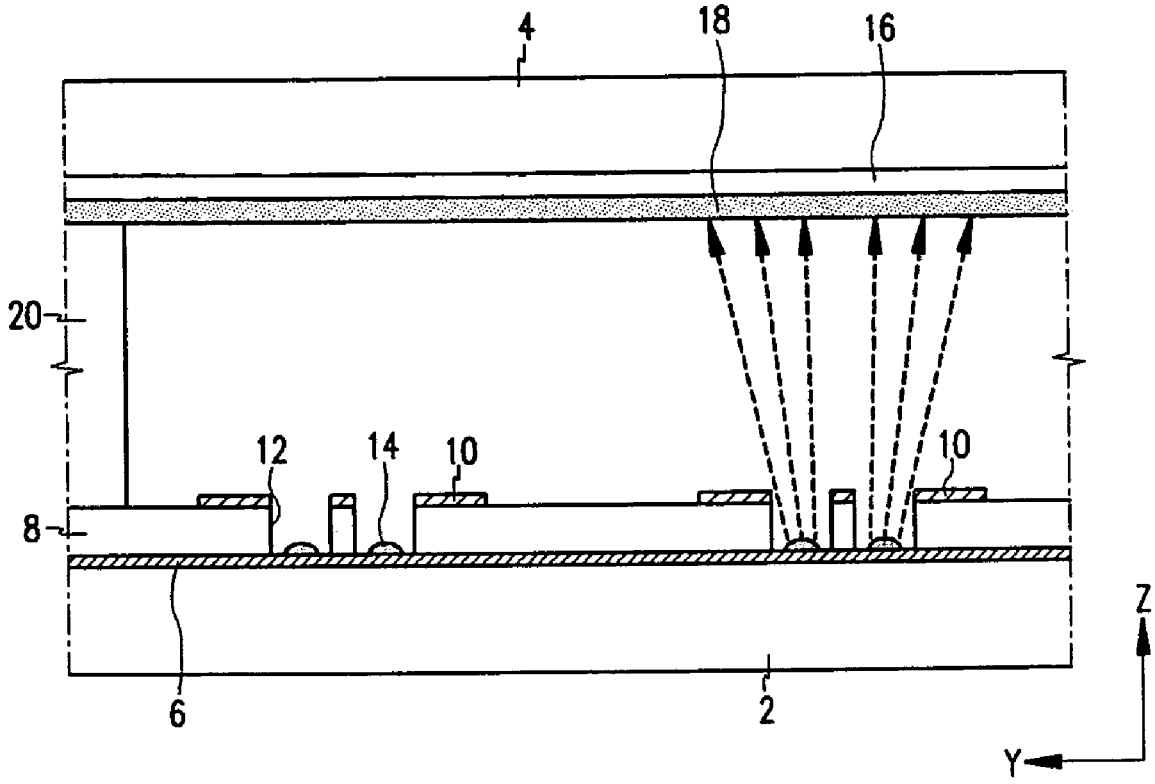
FIG. 2 is a partial sectional view of the electron emission device taken along line I-I of FIG. 1, in which the electron emission device is shown in an assembled state.
Figure 3:
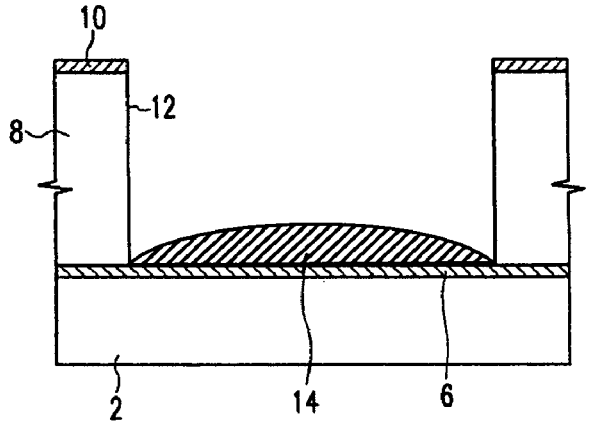
FIG. 3 is a partial sectional view of a specific area of the electron emission device of FIG. 2.

FIG. 1 is a partial exploded perspective view of an electron emission device according to a first exemplary embodiment of the present invention. FIG. 2 is a partial sectional view taken along line I-I of FIG. 1, in which the electron emission device is shown in an assembled state. FIG. 3 is a partial sectional view of a specific area of the electron emission device of FIG. 2.

An FEA type electron emission device, which is one example of the different types of cold cathode electron emission devices, includes a first substrate 2 and a second substrate 4. The first substrate 2 and the second substrate 4 are provided in opposition to one another with a predetermined gap therebetween. A structure to enable the emission of electrons by use of an electric field is provided on the first substrate 2, and a structure to enable the realization of luminescence by interaction with emitted electrons is provided on the second substrate 4.

In more detail, cathode electrodes 6 are formed on a surface of the first substrate 2 opposing the second substrate 4, and in a stripe pattern in one direction (for example, direction Y of the drawings). Further, an insulation layer 8 is formed over an entire surface of the first substrate 2 and covering the cathode electrodes 6. Gate electrodes 10 are formed on the insulation layer 8 in a stripe pattern in a direction substantially perpendicular to the direction of the cathode electrodes 6 (for example, direction X of the drawings). That is, long axes of the cathode electrodes 6 are positioned substantially in the direction Y, and long axes of the gate electrodes are positioned substantially in the direction X.

Pixel regions are defined by the intersection of the cathode electrodes 6 and the gate electrodes 10. At least one aperture 12 that passes through the gate electrodes 10 and the insulation layer 8 is formed at areas corresponding to each of the pixel regions. The apertures 12 expose the cathode electrodes 6 at these areas where they are formed. Further, an electron emission region 14 is formed within each of the apertures 12 on an exposed area of the corresponding cathode electrode 6.

In one embodiment, the electron emission regions 14 are made of a carbon-based material. Examples of carbon-based materials include carbon nanotubes, graphite, diamond, diamond-like carbon, and $C_{60}$ (Fullerene). The carbon-based material may be one or a combination of these materials. Furthermore, in the one embodiment, the electron emission regions 14 may be made of a nanometer-sized material that includes nano-tube, nano-fiber and nano-wire, such as carbon nano-tube and graphite nano-fiber. The nanometer-sized material also may be one or a combination of these materials.

Formed on a surface of the second substrate 4 opposing the first substrate 2 is an anode electrode 16, and a phosphor layer 18 is formed on the anode electrode 16. The anode electrode 16 is made of a transparent material, such as ITO (indium tin oxide), thereby enabling the transmission of visible light therethrough, the visible light being generated by the excitation of the phosphor layer 18. A metal layer (not shown) may be formed so as to cover the phosphor layer 18 and to provide a metal back effect for enhancing screen brightness. If such a configuration is used, the metal layer may be used in place of the anode electrode 16, and the anode electrode 16 need not be formed on the second substrate 4.

The first substrate 2 and the second substrate 4 structured as described above are sealed using a sealant (not shown) along opposing edges of the first substrate 2 and the second substrate 4. Sealing is performed in a state where there is a predetermined gap between the first substrate 2 and the second substrate 4. The air between the first substrate 2 and the second substrate 4 is exhausted to form a vacuum state therebetween of approximately $10^{-7}$ Torr. Prior to sealing the first substrate 2 and the second substrate 4, spacers 20 are provided therebetween so as to maintain the predetermined gap.

In the FEA type electron emission device structured as described above, predetermined external voltages are applied to the cathode electrodes 6, the gate electrodes 10, and the anode electrode 16 so as to drive the FEA type electron emission device. As an example, a positive voltage of a few to a few tens of volts is applied to the cathode electrodes 6, a positive voltage of a few tens of volts (obtained by adding a critical voltage to the cathode voltage) is applied to the gate electrodes 10, and a positive voltage of a few hundred to a few thousand volts is applied to the anode electrode 16.

As a result, an electric field is applied to the electron emission regions 14 in accordance with the difference in voltages between the cathode electrodes 6 and the gate electrodes 10 such that electrons are emitted from the electron emission regions 14. The emitted electrons are attracted toward the second substrate 4 by the high positive voltage applied to the anode electrode 16 so as to strike the phosphor layer 18. This excites the phosphor layer 18 so that it illuminates. Such an operation is selectively performed to realize the display of images.

A surface formation of the electron emission regions 14 in the FEA type electron emission device according to the first exemplary embodiment of the present invention will now be described. It will be shown that, by forming the electron emission regions 14 in a particular manner, a uniform electric field is able to be applied to the electron emission regions 14.

By viewing the distribution of equipotential lines when there are no electron emission regions 14 positioned within the apertures 12, and when predetermined drive voltages are applied to the cathode electrodes 6, the gate electrodes 10 and the anode electrode 16, the manner in which the electron emission regions 14 should be formed (i.e., their surface formation) may be determined.

The instance wherein an electric field strength E-1, applied to the electron emission regions 14 in accordance with a difference in voltage between the cathode electrodes 6 and the gate electrodes 10, is greater than an electric field strength E-2, applied to the electron emission regions 14 in accordance with a difference in voltage between the cathode electrodes 6 and the anode electrode 16, will first be examined.

Figure 4:
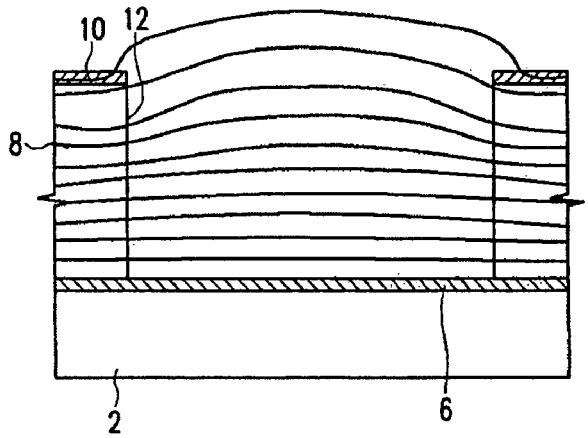
FIG. 4 is a partial sectional view of a specific area of the electron emission device of FIG. 1, illustrating the distribution of equipotential lines in the case where no electron emission region is formed in an aperture.

FIG. 4 is a partial sectional view of a specific area of the FEA type electron emission device of FIG. 1, illustrating the distribution of equipotential lines in the case where no electron emission region is formed in an aperture. Further, the equipotential line distribution shown in FIG. 4 is that obtained when 0V are applied to the cathode electrode 6, 60V are applied to the gate electrode 10, and 1 kV is applied to the anode electrode 16 (see FIG. 2), and the resulting electric field strengths E-1 and E-2 are 6V/μm and 2V/μm, respectively.

The FEA type electron emission device used to perform the measurements had the following dimensions: an aperture diameter of 30 μm, a distance between the cathode electrodes 6 and the gate electrodes 10 (i.e., an insulation layer thickness) of 10 μm, and a distance between the cathode electrodes 6 and the anode electrode 16 of 500 μm.

With reference to FIG. 4, the equipotential line distribution in the aperture 12 is such that the equipotential lines in a bottom portion of the aperture 12 (in the vicinity of the cathode electrode 6) are substantially flat, but they begin to protrude outward in a convex configuration in a direction away from the cathode electrode 6 in the vicinity of the gate electrode 10. This protruding formation of the equipotential lines becomes increasingly pronounced as the distance from the cathode electrode 6 increases.

The electron emission regions 14 in the first exemplary embodiment of the present invention are formed with such a distribution of the equipotential lines in mind. That is, with reference to FIG. 3, each of the electron emission regions 14 is formed with a thickness that is smallest at edges of the corresponding aperture 12, and a thickness that gets increasingly larger toward a center of the aperture 12, thereby resulting in the greatest thickness being at substantially the center of the aperture 12. Hence, the electron emission region 14 is convexly formed. When viewed from above (in the direction Z toward the first substrate 2 as seen in FIGS. 1 and 2), the diameter of the electron emission region 14 is either smaller than, or substantially identical to, the diameter of the aperture 12.

Figure 5:
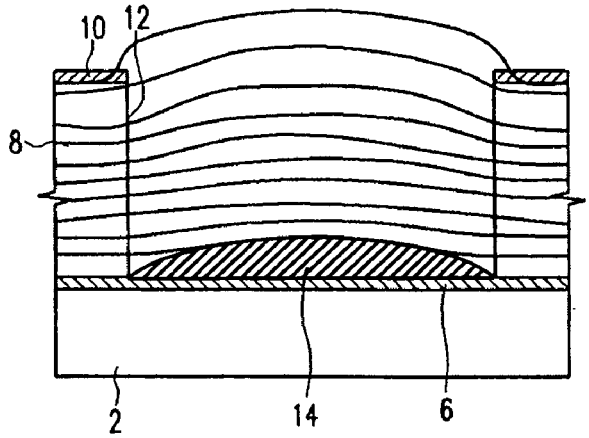
FIG. 5 is a partial sectional view of a specific area of the electron emission device of FIG. 1, illustrating the distribution of equipotential lines formed in an area surrounding an electron emission region.
Figure 6:
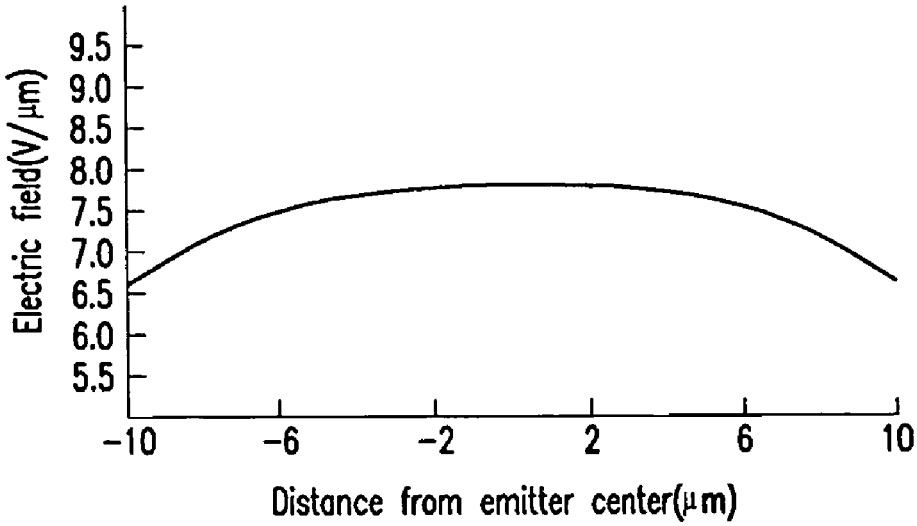
FIG. 6 is a graph showing measured electric field intensity as a function of position on an electron emission region surface of the electron emission device of FIG. 1, wherein the horizontal axis indicates the distance from a center of the electron emission region.

FIG. 5 is a partial sectional view of a specific area of the FEA type electron emission device of FIG. 1, illustrating the distribution of equipotential lines formed in an area surrounding an electron emission region, and FIG. 6 is a graph showing measured electric field intensity as a function of position on an electron emission region surface of the electron emission device of FIG. 1, wherein the horizontal axis indicates the distance from a center of the electron emission region.

The following conditions were used for the FEA type electron emission device used to perform the equipotential line experiment: the aperture diameter was 20 μm, a maximum thickness of the electron emission regions 14 at centers of the apertures 12 was 2 μm, and the voltages applied to the cathode electrodes 6, the gate electrodes 10 and the anode electrode 16 were identical to those used to test equipotential line distribution when no electron emission region was formed in the aperture 12.

With the surface formation of the electron emission regions 14 being a smoothly formed convex shape as described above, the electric field applied to the electron emission regions 14 when the particular drive voltages are applied to the electrodes 6, 10 and 16 is not concentrated at any one area of the electron emission regions 14. The electric field applied to the electron emission regions 14 is instead nearly uniform over the entire surface thereof.

The end result of having an almost uniform electric field applied to the electron emission regions 14 is that electrons are emitted more uniformly from the entire surface of the electron emission regions 14. Hence, electron beam diffusion is minimized such that color purity is increased, and heating of the electron emission regions 14 is prevented, thereby increasing the life of the electron emission regions 14.

Results when slightly altering the conditions will now be examined. In particular, the distribution of equipotential lines will be examined when the electric field intensity E-1 applied to the electron emission regions 14 in accordance with the difference in voltages between the cathode electrodes 6 and the gate electrodes 10 is less than the electric field intensity E-2 applied to the electron emission regions 14 in accordance with the difference in voltages between the cathode electrodes 6 and the anode electrode 16.

Figure 7:
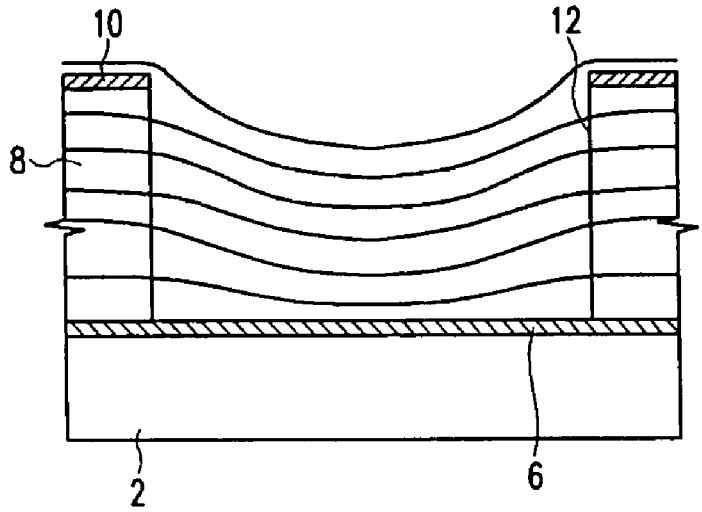
FIG. 7 is a partial sectional view of a specific area of an FEA type electron emission device according to a second exemplary embodiment of the present invention, illustrating the distribution of equipotential lines in the case where no electron emission region is formed in an aperture.

FIG. 7 is a partial sectional view of a specific area of an FEA type electron emission device according to a second exemplary embodiment of the present invention, illustrating the distribution of equipotential lines in the case where no electron emission region is formed in an aperture.

The FEA type electron emission device used to perform the measurements had dimensions identical to those of the first exemplary embodiment (wherein no electron emission region is formed in an aperture 12). However, the equipotential line distribution shown in FIG. 7 is that obtained when 0V are applied to a cathode electrode 6, 0V are applied to a gate electrode 10, and 10 kV are applied to an anode electrode 16, and the resulting electric field strengths E-1 and E-2 are 0V/μm and 20V/μm, respectively.

As shown in FIG. 7, the equipotential lines formed in the aperture 12 are curved into concave shapes directed toward a first substrate 2. Accordingly, a surface formation of electron emission regions according to the second exemplary embodiment of the present invention is formed corresponding to this formation of the equipotential lines (i.e., having a concavely formed curvature directed toward the first substrate 2).

Figure 8:
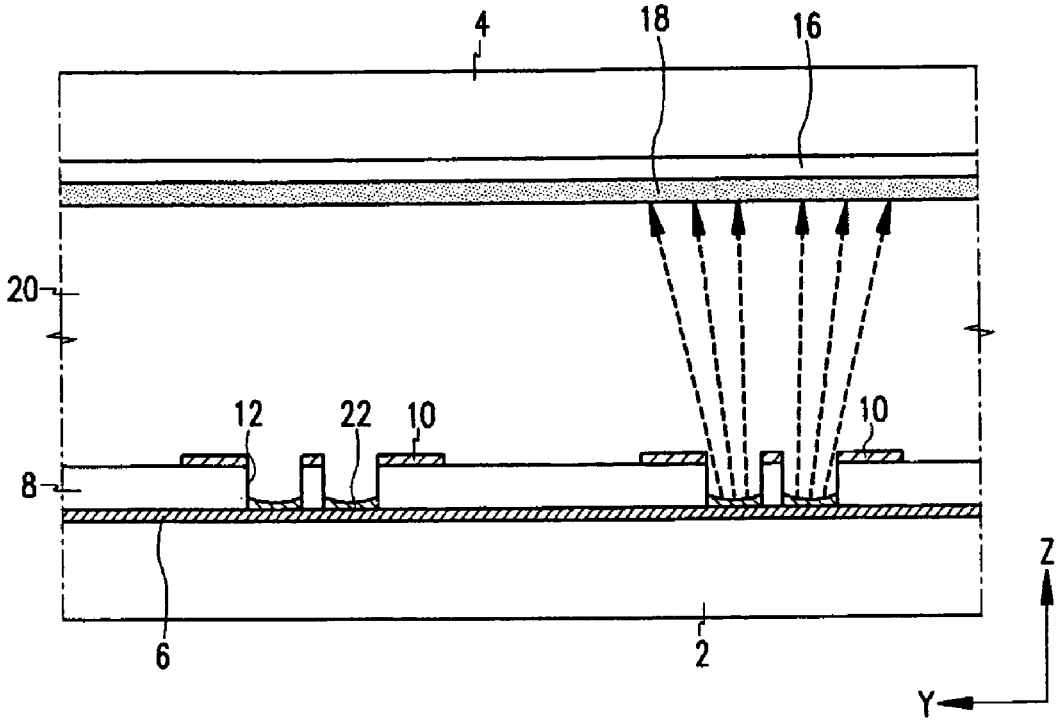
FIG. 8 is a partial sectional view of the FEA type electron emission device according to the second exemplary embodiment of the present invention.
Figure 9:
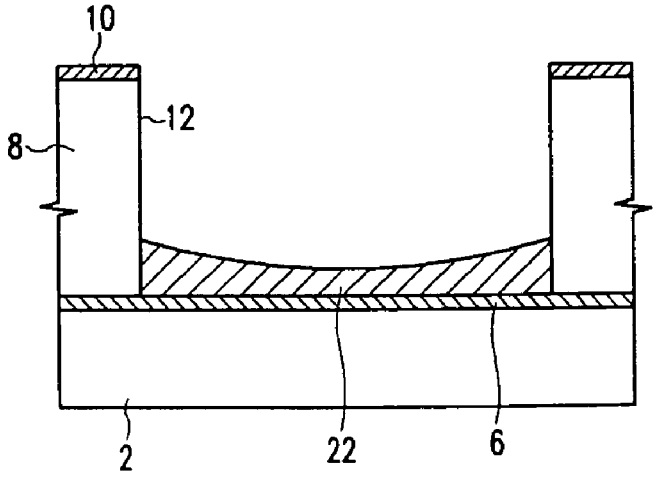
FIG. 9 is a partial sectional view of a specific area of the FEA type electron emission device of FIG. 8.

FIG. 8 is a partial sectional view of the FEA type electron emission device according to the second exemplary embodiment of the present invention, and FIG. 9 is a partial sectional view of a specific area of the FEA type electron emission device of FIG. 8.

In this exemplary embodiment, electron emission regions 22 contact an insulation layer 8, and have a thickness that is largest at edges of the apertures 12 adjacent to where they contact the insulation layer 8. The thickness of the electron emission regions 22 decreases gradually from these points of contact with the insulation layer 8 such that the thickness thereof is smallest at center areas of the electron emission regions 22. A surface formation of the electron emission regions 22 corresponds to such a change in thickness. That is, outer surfaces of the electron emission regions 22 are concavely formed toward the first substrate 2. Furthermore, when viewed from above (in direction Z toward the first substrate 2 as seen in FIG. 8), a diameter of the electron emission regions 14 is substantially identical to a diameter of the apertures 12.

Figure 10:
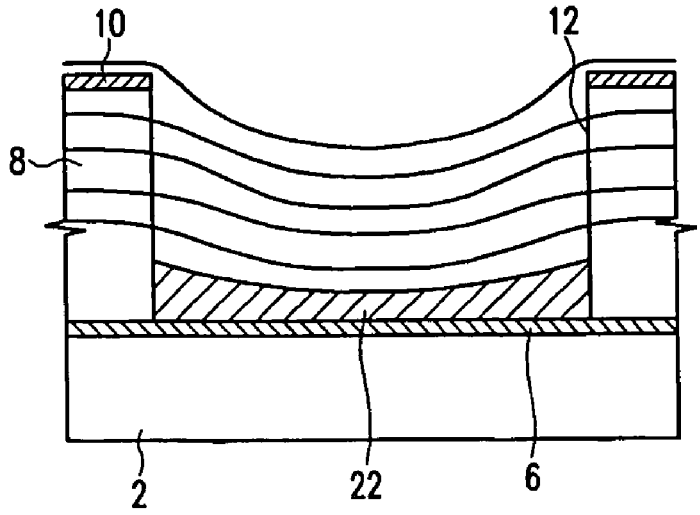
FIG. 10 is a partial sectional view of a specific area of the FEA type electron emission device of FIG. 8, illustrating the distribution of equipotential lines formed in an area surrounding an electron emission region.
Figure 11:
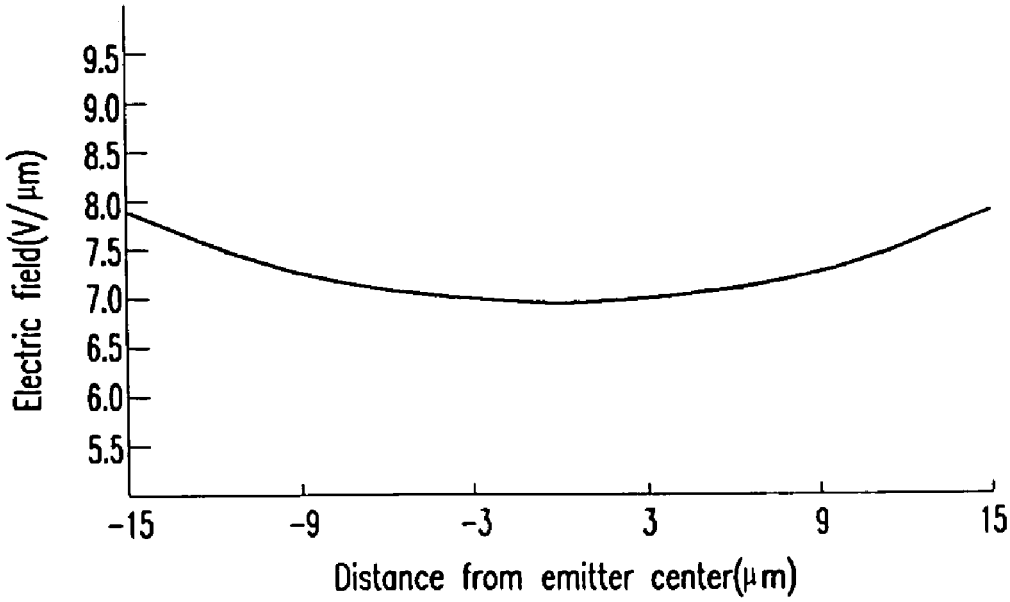
FIG. 11 is a graph showing measured electric field intensity as a function of position on an electron emission region surface of the FEA type electron emission device of FIG. 8, wherein the horizontal axis indicates the distance from a center of the electron emission region.

FIG. 10 is a partial sectional view of a specific area of the FEA type electron emission device of FIG. 8, illustrating the distribution of equipotential lines formed in an area surrounding one of the electron emission regions 22, and FIG. 11 is a graph showing measured electric field intensity as a function of position on an electron emission region surface of the FEA type electron emission device of FIG. 8, wherein the horizontal axis indicates the distance from a center of the electron emission region 22.

The FEA type electron emission device used to perform the experiment had dimensions as follows: an electron emission region diameter of 30 μm, a maximum thickness of the electron emission region 22 (at edges of the aperture 12) of 2.5 μm, and a minimum thickness of the electron emission region 22 (at the center of the aperture 12) of 1.5 μm. Furthermore, as described with reference to FIG. 7, 0V were applied to the cathode electrode 6, 0V were applied to the gate electrode 10, and 10 kV were applied to the anode electrode 16 (see FIG. 18).

With the surface of the electron emission regions 22 in a smoothly formed concave shape as described above, the electric field applied to the electron emission regions 22, when the above specific drive voltages are applied to the electrodes 6, 10 and 16, is not concentrated at any one area of the electron emission regions 22. The electric field applied to the electron emission regions 22 is instead nearly uniform over the entire surface thereof. This is evidenced also by the graph of FIG. 11.

The end result of having an almost uniform electric field applied to the electron emission regions 22 in the second exemplary embodiment is identical to that of the first exemplary embodiment. That is, electrons are emitted more uniformly from the entire surface of the electron emission regions 22 such that electron beam diffusion is minimized so as to increase color purity, and heating of the electron emission regions 22 is prevented, thereby increasing the life of the electron emission regions 22.

Electron beam diffusion can be further prevented by limiting an electron emission region of the electron emission regions in the apertures 12 while using the basic configurations described above. This will be described below.

Figure 12:
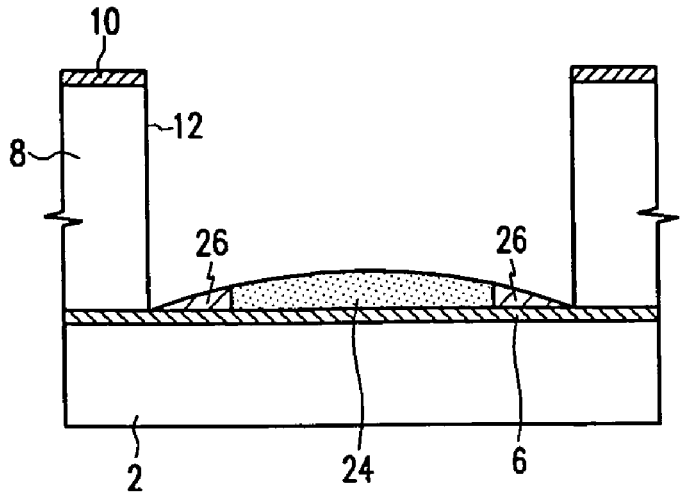
FIG. 12 is a partial sectional view of a specific area of an FEA type electron emission device according to a third exemplary embodiment of the present invention.

FIG. 12 is a partial sectional view of a specific area of an FEA type electron emission device according to a third exemplary embodiment of the present invention. In this embodiment, an electron emission region 24 is positioned on a cathode electrode 6 in a center area of an aperture 12, and is sized such that outer edges of the electron emission region 24 are provided at a predetermined distance from an insulation layer 8. A non-discharge conducting layer 26 surrounds the outer edges of the electron emission region 24 and extends toward the insulation layer 8. The combined configuration of the electron emission region 24 and the non-discharge conducting layer 26 is similar to the configuration of the electron emission region 14 of the first exemplary embodiment (see FIG. 3). That is, the combined configuration of the electron emission region 24 and the non-discharge conducting layer 26 is convexly formed, protruding in a direction away from the cathode electrode 6.

Figure 13:
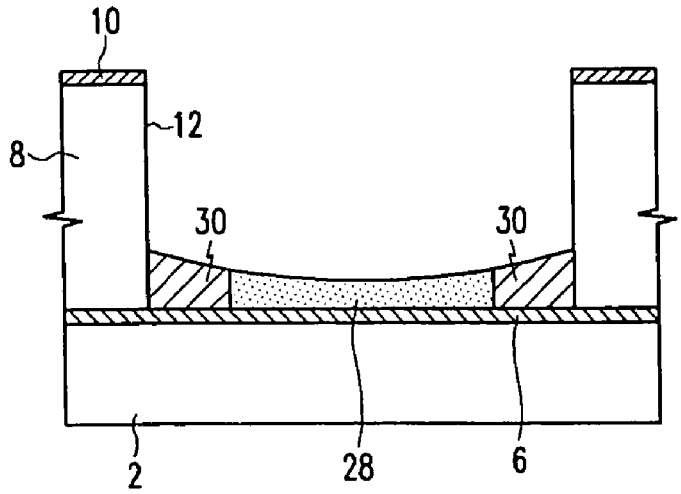
FIG. 13 is a partial sectional view of a specific area of an FEA type electron emission device according to a fourth exemplary embodiment of the present invention.

FIG. 13 is a partial sectional view of a specific area of an FEA type electron emission device according to a fourth exemplary embodiment of the present invention. In this embodiment, an electron emission region 28 is positioned on a cathode electrode 6 in a center area of an aperture 12, and is sized such that outer edges of the electron emission region 28 are provided at a predetermined distance from an insulation layer 8. A non-discharge conducting layer 30 surrounds the outer edges of the electron emission region 28 and extends toward the insulation layer 8. The combined configuration of the electron emission region 28 and the non-discharge conducting layer 30 is similar to the configuration of the electron emission region 22 of the second exemplary embodiment (see FIG. 9). That is, the combined configuration of the electron emission region 28 and the non-discharge conducting layer 30 is concavely formed with its depression directed toward the cathode electrode 6.

With these configurations of the third and fourth exemplary embodiments, an electric field is uniformly applied to surfaces of the electron emission regions 24 and 28 as in the above embodiments. In addition, electron emission is concentrated at center areas of the apertures 12 as a result of the above-described formation of the electron emission regions 24 and 28 such that electron beam diffusion is further prevented, ultimately enhancing color purity of the FEA type electron emission display device.

In the electron emission device of the present invention described above, an electric field is uniformly formed on a surface of each of the electron emission regions. As a result, the emission of electrons occurs evenly over the entire surface of the electron emission regions, thereby enhancing color purity by the minimization of electron beam diffusion, and preventing the electron emission regions from becoming overly heated so that they have a longer life.

Although embodiments of the present invention have been described in detail hereinabove in connection with certain exemplary embodiments, it should be understood that the invention is not limited to the disclosed exemplary embodiments, but, on the contrary is intended to cover various modifications and/or equivalent arrangements included within the spirit and scope of the present invention, as defined in the appended claims.

Figure 14:
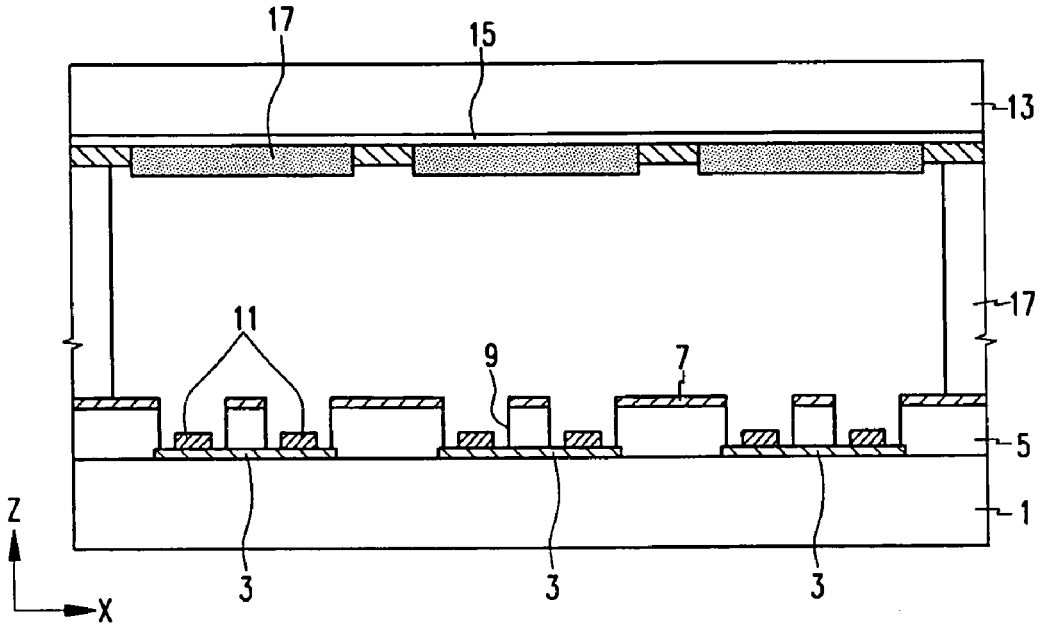
FIG.14(Prior Art)
FIG. 14 is a partial sectional view of a conventional FEA type electron emission device utilizing a top-gate structure.
Figure 15:
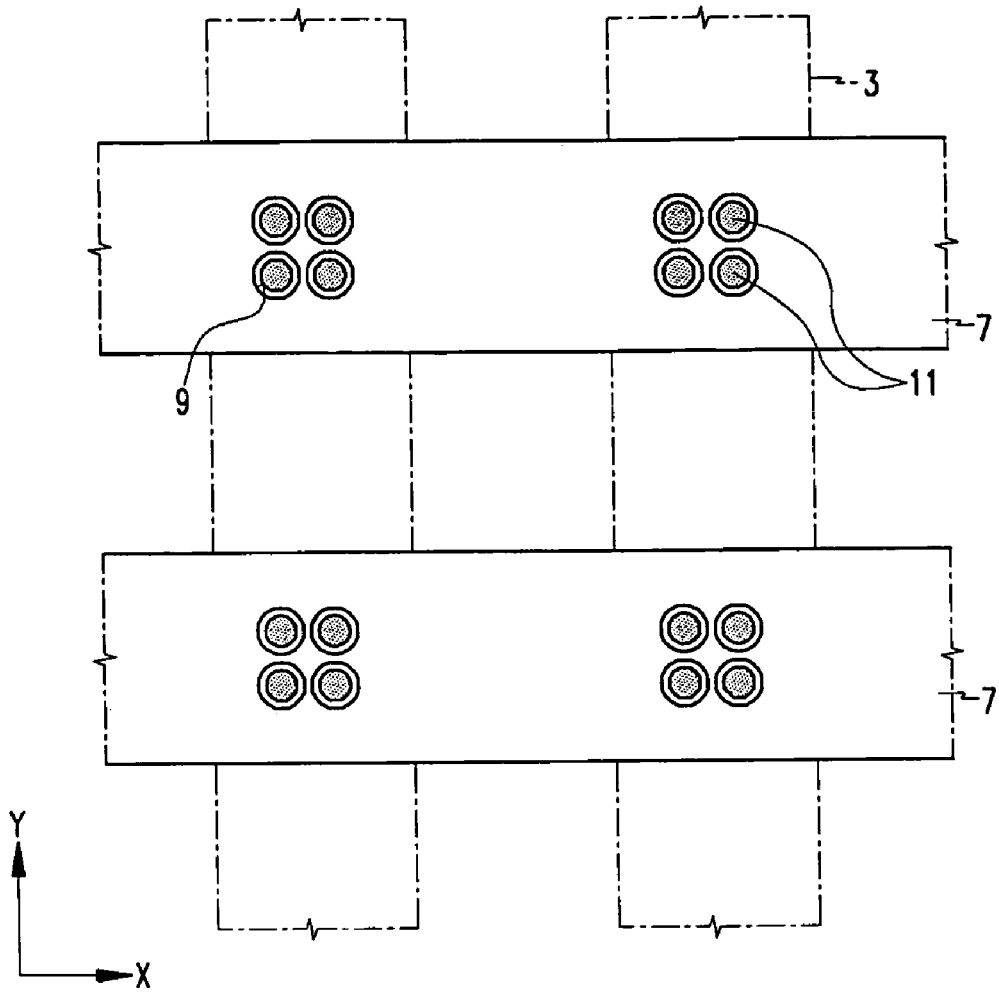
FIG.15(Prior Art)
FIG. 15 is a partial plan view of a rear substrate of the electron emission device of FIG. 14.

FIG. 14 is a partial sectional view of a conventional FEA type electron emission device utilizing a top-gate structure, and FIG. 15 is a partial plan view of a rear substrate of the FEA type electron emission device of FIG. 14.

Cathode electrodes 3, an insulation layer 5, and gate electrodes 7 are formed in that order on a rear substrate 1. The cathode electrodes 3 are formed in a line pattern, and the gate electrodes 7 are formed in a line pattern substantially perpendicular to the cathode electrodes 3. Apertures 9 are formed at areas where the cathode electrodes 3 intersect the gate electrodes 7. The apertures 9 pass through the gate electrodes 7 and the insulation layer 5 to expose the cathode electrodes 3 at the areas of intersection. An electron emission region 11 is mounted in each of the apertures 9 and on a corresponding exposed area of the cathode electrodes 3. The electron emission regions 11 emit electrons under specific driving conditions. An anode electrode 15 and phosphor layers 17 are formed on a surface of a front substrate 13 opposing the rear substrate 1.

The front substrate 13 and the rear substrate 1 are sealed together using a sealant (not shown). Also, the space between the front substrate 13 and the rear substrate 1 is evacuated to a high vacuum state of approximately $10^{-7}$ Torr. Prior to sealing the front substrate 13 and the rear substrate 1, spacers 17 are provided therebetween to maintain a predetermined gap between these elements.

The electron emission regions 11 are typically produced using a paste having a viscosity suitable for printing. The paste is made by mixing polymer and nanometer size material, such as carbon nanotube powder, in a solvent. Following printing of the paste on exposed portions of the cathode electrodes 3, drying and sintering are performed to complete the formation of the electron emission regions 11. The electron emission regions 11 are formed to a smaller size than the apertures 9, and to a uniform thickness.

However, a problem with the above method is that, although the electron emission regions 11 are easy to manufacture, they are not formed by taking into account electric field intensity levels and electron beam emission patterns. That is, such a method of manufacturing the electron emission regions 11 is pursued out of convenience (i.e., to make manufacture easy), and no attempt is made to form the electron emission regions 11 so that FEA type performance is enhanced.

Figure 16:
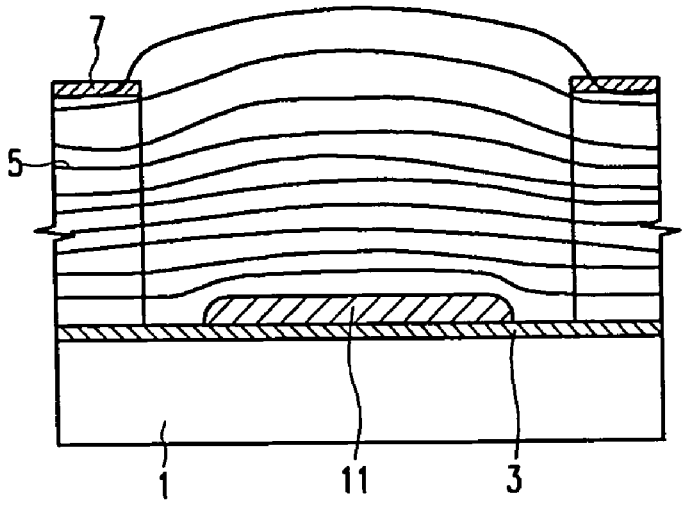
FIG.16(Prior Art)
FIG. 16 is a partial sectional view of a specific area of the FEA type electron emission device of FIG. 14, illustrating the distribution of equipotential lines formed in the area surrounding an electron emission region.
Figure 17:
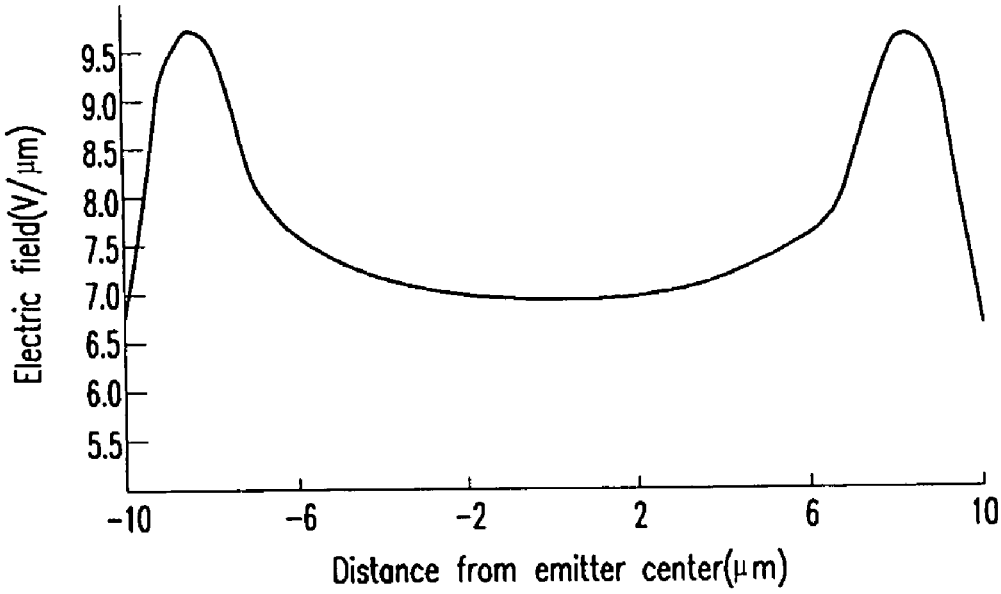
FIG.17(Prior Art)
FIG. 17 is a graph showing measured electric field intensity as a function of position on an electron emission region surface, wherein the horizontal axis indicates the distance from a center of the electron emission region.

FIG. 16 is a partial sectional view of a specific area of the FEA type electron emission device of FIG. 14, illustrating the distribution of equipotential lines formed in an area surrounding one of the electron emission regions 11. FIG. 17 is a graph showing measured electric field intensity as a function of position on an electron emission region surface, wherein the horizontal axis indicates the distance from a center of the electron emission region.

The FEA type electron emission device used to perform the measurements had the following dimensions: an aperture diameter of 30 μm, an insulation layer thickness of 15 μm, and an electron emission region diameter and thickness of 20 μm and 2 μm, respectively. Further, 0V were applied to the cathode electrodes 3, 60V to the gate electrodes 7, and 1 kV to the anode electrode 15.

With the application of these predetermined drive voltages to the cathode electrodes 3 and the gate electrodes 7, the electric field on the surface of the electron emission regions 11 was not uniform. Instead, it was concentrated at peripheries thereof. This results from the peripheries of the electron emission regions 11 being closest to the gate electrodes 7, and therefore being affected the most by gate voltages applied to the gate electrodes 7.

As a result of this phenomenon, more electrons are emitted from edges of the electron emission regions 11, rather than being emitted uniformly over an entire area thereof. Hence, the resulting electron beams diffuse outwardly, thereby reducing color purity. Also, the electron emission regions 11 become more easily deteriorated, such that the life of the electron emission regions 11 is reduced.

What is claimed is:

1. An electron emission device, comprising:

a first substrate and a second substrate provided in opposition to one another with a predetermined gap therebetween;

a plurality of cathode electrodes formed on a surface of the first substrate opposing the second substrate;

an insulation layer formed so as to cover the cathode electrodes and having a plurality of apertures that pass therethrough formed at predetermined locations;

a plurality of gate electrodes formed on the insulation layer and having a plurality of apertures that pass therethrough, the apertures of the gate electrodes being formed at areas corresponding to the apertures of the insulation layer, and the apertures of the gate electrodes and the apertures of the insulation layer exposing the cathode electrodes;

a plurality of electron emission regions formed in the apertures at areas wherein the cathode electrodes are exposed; and an anode electrode formed on a surface of the second substrate opposing the first substrate;

wherein a surface of the electron emission regions opposite a surface adjacent to the cathode electrodes is curved with a predetermined radius of curvature;

wherein the electron emission regions are positioned within the apertures and in contact with the insulation layer; and wherein the surface of the electron emission regions opposite a surface adjacent to the cathode electrodes is formed with a shape similar to an overall shape of equipotential lines formed in the apertures when there is no electron emission region in the apertures, and predetermined drive voltages are applied to the cathode electrodes, the gate electrodes and the anode electrode.

2. The electron emission device of claim 1, wherein the electron emission regions are made of a nanometer-sized material.

3. The electron emission device of claim 2, wherein the nanometer-sized material is selected from a group consisting of nano-tube, nano-fiber, nano-wire, and a combination of these materials.

4. The electron emission device of claim 1, wherein the electron emission regions are made of a carbon-based material.

5. The electron emission device of claim 4, wherein the carbon-based material is selected from a group consisting of carbon nanotubes, graphite, diamond, diamond-like carbon, $C_{60}$ (Fullerene), and a combination of these materials.

* * * * *